US009403066B2

(12) United States Patent
Esposito

(10) Patent No.: US 9,403,066 B2
(45) Date of Patent: Aug. 2, 2016

(54) ADJUSTABLE GOLF CLUB SYSTEM

(71) Applicant: Brian Esposito, Las Vegas, NV (US)
(72) Inventor: Brian Esposito, Las Vegas, NV (US)

( * ) Notice: Subject to any disclaimer, the term of this patent is extended or adjusted under 35 U.S.C. 154(b) by 0 days.
(21) Appl. No.: 14/455,723
(22) Filed: Aug. 8, 2014
(65) Prior Publication Data
US 2015/0045137 A1 Feb. 12, 2015

Related U.S. Application Data
(60) Provisional application No. 61/863,800, filed on Aug. 8, 2013.
(51) Int. Cl.
*A63B 53/02* (2015.01)
*A63B 53/06* (2015.01)
*A63B 53/04* (2015.01)
(52) U.S. Cl.
CPC ..... *A63B 53/02* (2013.01); *A63B 53/04* (2013.01); *A63B 53/0487* (2013.01); *A63B 53/065* (2013.01); *A63B 2053/023* (2013.01); *A63B 2053/025* (2013.01); *A63B 2053/028* (2013.01); *A63B 2053/0408* (2013.01); *A63B 2053/0491* (2013.01)
(58) Field of Classification Search
CPC .... A63B 53/02; A63B 53/0487; A63B 53/04; A63B 2053/023; A63B 2053/028; A63B 2053/0408; A63B 2053/0491; A63B 2053/025; A63B 53/065
See application file for complete search history.

(56) References Cited

U.S. PATENT DOCUMENTS 2,155,830 A * 4/1939 Howard ..... A63B 53/06 473/246
2,932,515 A 4/1960 May
3,220,733 A * 11/1965 Saleeby ..... A63B 53/0487 473/335
4,736,951 A * 4/1988 Grant ..... A63B 53/06 473/246
5,244,205 A 9/1993 Melanson et al.
5,390,918 A 2/1995 Meyers et al.
5,692,969 A 12/1997 Schooler
5,863,257 A 1/1999 Busnardo
6,001,024 A 12/1999 Van Alen, II et al.
6,302,614 B1 * 10/2001 Tseng ..... F16B 7/1463 248/125.8
6,478,690 B2 * 11/2002 Helmstetter ..... A63B 53/0487 473/324
6,723,000 B1 4/2004 Dombrowski
6,743,112 B2 * 6/2004 Nelson ..... A63B 53/0487 473/251
8,133,129 B2 * 3/2012 Boyd ..... A63B 53/047 473/288
2001/0055434 A1 * 12/2001 Wershe ..... F16C 19/54 384/544
2007/0004528 A1 * 1/2007 Hocknell ..... A63B 53/02 473/287

FOREIGN PATENT DOCUMENTS

FR 1236182 A * 7/1960 ..... B63B 59/04
JP 2000329273 A * 11/2000

* cited by examiner

*Primary Examiner* — Stephen Blau
(74) *Attorney, Agent, or Firm* — Howard & Howard Attorneys PLLC

(57) ABSTRACT

An adjustable golf club system is described herein. The adjustable golf club system includes a club shaft, a club head, a hosel, and an adjustment assembly that is removably coupled to the club head and the hosel to facilitate adjusting an orientation of the hosel with respect to the club head. The club head includes a club head cavity that extends between a toe portion and a heal portion. The hosel includes a first end that is coupled to the club shaft and a second end that includes a fastener head. The adjustment assembly includes a sliding member and a hosel fastener that is coupled to the sliding member. The sliding member is positioned within the club head cavity and movable between the toe portion and the heal portion. The hosel fastener extends through the fastener head to the sliding member to couple the hosel to the club head.

20 Claims, 14 Drawing Sheets

ADJUSTABLE GOLF CLUB SYSTEM

CROSS-REFERENCE TO RELATED APPLICATION

This application claims priority to U.S. Provisional Application No. 61/863,800, filed Aug. 8, 2013, the disclosure of which is hereby incorporated by reference in their entirety.

TECHNICAL FIELD

The subject matter disclosed herein relates generally to golf clubs, and more particularly, to an adjustable golf club system including a golf club having a club head with an adjustable lie angle and adjustable connection/insertion point to the clubhead.

BACKGROUND OF THE INVENTION

The game of golf has continued to increase in popularity over the years with an increase in the number of players playing the sport. At least some known golf clubs are produced with standardized club lengths and club angles that are marketed to a large population of players. Because of the standard lengths and lie angles, each player may be required to adjust their more natural swing and/or swing stance to accommodate the standard golf club. At least some known golf clubs may be custom-made to include predefined customized club lengths to suit a particular player. However, these customized clubs are typically made based on a player's current swing and swing stance and are not able to accommodate changes in the player's swing as the skill and strength of the player changes over time.

As such, it is desirable to provide a golf club system that may be adjusted to suit the changes in the player's swing and swing stance over time and allows a golfer to make adjustments to the golf club on his own, to enable the player to continue to improve their golf game while using the same golf club. The present invention is aimed at the problem identified above.

SUMMARY OF THE INVENTION

In one aspect of the present invention, an adjustable golf club system is provided. The adjustable golf club system includes a club shaft, a club head, a hosel, and an adjustment assembly that is removably coupled to the club head and the hosel to facilitate adjusting an orientation of the hosel with respect to the club head. The club head includes a body including a front club face and an opposite rear club face. Each of the front club face and the rear club face extends between a toe portion and a heel portion along a longitudinal axis. A recessed portion is defined along the rear club face and has an inner surface that defines a club head cavity that extends between the toe portion and the heel portion along the longitudinal axis. The hosel includes a first end and an opposite second end. The first end is adapted to be coupled to the club shaft. The second end includes a fastener head that has an opening that extends through the fastener head. The adjustment assembly includes a sliding member and a hosel fastener that is removably coupled to the sliding member. The sliding member is positioned within the club head cavity and movable along the longitudinal axis between the toe portion and the heel portion. The hosel fastener extends through the fastener head to the sliding member to contact an outer surface of the hosel second end to couple the hosel to the club head.

In another aspect of the present invention, an adjustable golf club system is provided. The adjustable golf club system includes a club head, a hosel, and an adjustment assembly that is removably coupled to the club head and the hosel to facilitate adjusting an orientation of the hosel with respect to the club head. The club head includes a body that includes a front club face and an opposite rear club face. Each of the front club face and the rear club face extend between a toe portion and a heel portion along a longitudinal axis. A recessed portion is defined along the rear club face and has an inner surface that defines a club head cavity that extends between the toe portion and the heel portion along the longitudinal axis. The hosel includes a first end and an opposite second end. The first end is adapted to be coupled to a club shaft. The second end includes a fastener head that has an opening extending through the fastener head. The adjustment assembly includes a sliding member and a hosel fastener that is removably coupled to the sliding member. The sliding member is positioned within the club head cavity and movable along the longitudinal axis between the toe portion and the heel portion. The hosel fastener extends through the fastener head to the sliding member to contact an outer surface of the hosel second end to couple the hosel to the club head.

In a further aspect of the present invention, an adjustable golf club system is provided. The adjustable golf club system includes a hosel and a shaft attachment assembly that is coupled between the hosel and a club shaft to facilitate removably coupling the club shaft to the hosel. The hosel includes a first end and an opposite second end. The first end includes a shaft connection head that is adapted to be coupled to the club shaft. The shaft connection head includes a shaft opening that extends therethrough. The second end includes a fastener head that is configured to be coupled to a club head. The shaft attachment assembly includes a shaft connection cap and a shaft connection sleeve. The shaft connection cap includes an upper portion that has a first open end, a lower portion that has a second open end, and an inner surface that defines a connection cap cavity that extends between the first open end and the second open end along a centerline axis. The connection cap cavity is configured to receive the club shaft therein through the first open end. The shaft connection sleeve is positioned within the connection cap cavity and extends through the second open end. The shaft connection sleeve has an inner surface that defines an interior cavity that extends therethrough and is configured to receive the club shaft therein. The shaft connection sleeve includes a base member and a plurality of clamping members that extend outwardly from the base member along the centerline axis. The base member has a threaded outer surface configured to engage a corresponding threaded portion of the inner surface of the shaft connection cap to rotatably couple the shaft connection sleeve to the shaft connection cap. The inner surface of the shaft connection cap contacts the clamping members to bias the clamping members towards the club shaft to contact an outer surface of the club shaft to facilitate forming a friction fit between the clamping members and the club shaft.

In yet another aspect of the present invention, an adjustable golf club system is provided. The adjustable golf club system includes a club shaft, a club head, and an adjustment assembly that is coupled to the hosel and the club head to facilitate adjusting the orientation of the club head with respect to the club shaft. The club shaft includes a telescoping body that enables the overall length of the club shaft to be adjusted. The adjustment assembly is configured to enable the orientation of the club head to be adjusted with respect to the club shaft to facilitate adjusting the lie angle of the club head and the shaft position within the clubhead (i.e. heel-shafted to centershafted). The position of the shaft allows the golfer to customize their stroke. The club head includes one or more removable weighted plates to allow a player to adjust the weight of the club head by adding or removing weighted plates from the club head. The removable weighted plates also allow the golfer to adjust the heel or toe weight of the clubhead. This is critical to create the appropriate balance/weight distribution within the putter head relative to the shaft position along the shaft axis.

Telescoping Shaft. The Telescoping Shaft will allow the putter to adjust from 30" to 40" and any place in between. Using a locking collar, the grip will be secured to the prescribed height using the threaded insert allowing the grip to have a solid feel.

Replaceable Hosel. A threaded insert will be installed at the tip of the shaft that will allow for the male-end of the hosel to secure into the shaft without the use of epoxy. This will speed up fittings and allow the golfer to immediately make adjustments and test his/her customized putter with immediate feedback. Various hosel designs will be created with the male-end thread so that the golfer can select and switch the hosel of his/her choice at any moment.

Weighted Insert Plate. The weighted insert plate will be installed by unscrewing the each bolt on the heel and tow of the putter. The back of the putter will come off and the weighted insert plate will be installed. The back of the putter will go back on and the bolts will be secured so that the putter is complete. This will allow the golfer to play with a weighted putter that fits his/her preference. A toe weight and heel weight will be created to fit together or be used separately. This allows the golfer to match the weight to their natural stroke.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
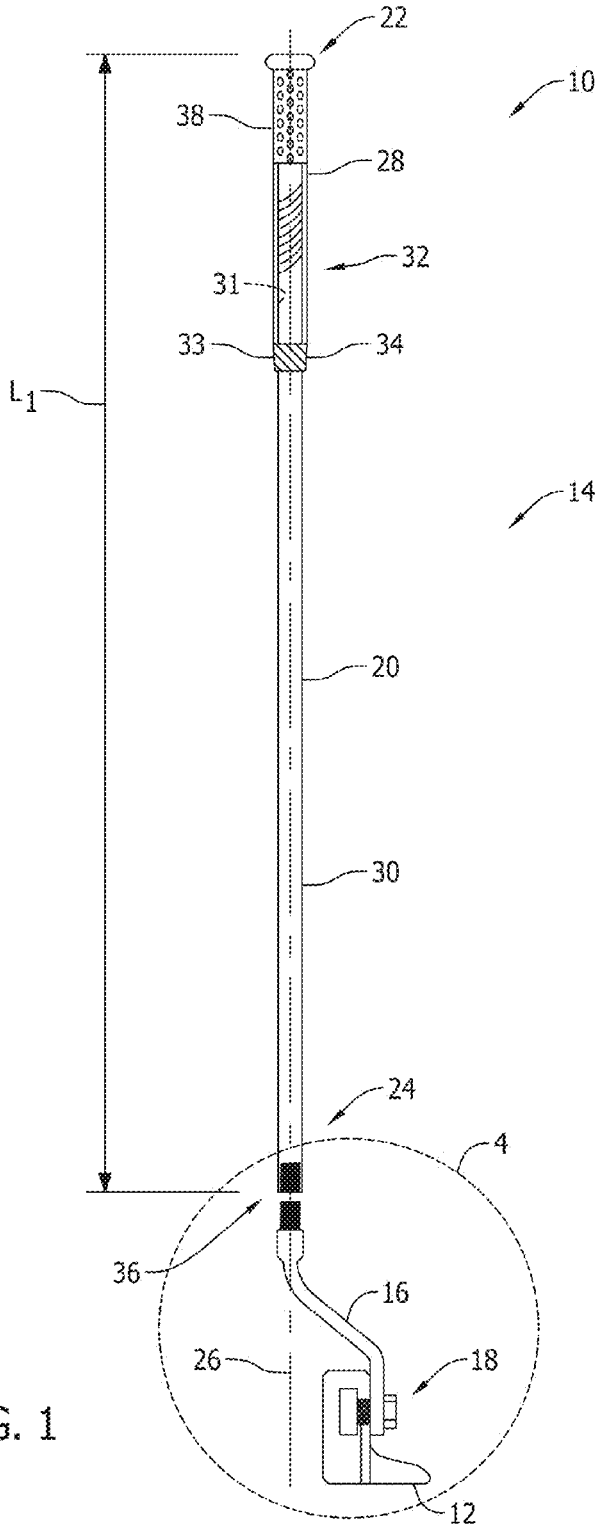
FIG. 1 is a perspective view of an adjustable golf club system, according to an embodiment of the present invention.

With reference to the drawings and in operation, the invention overcomes at least some disadvantages of known golf clubs by providing a golf club system that enables a player to adjust an overall height of the golf club and an orientation of the club head to customize the golf club to suit the height, stance, swing path, and personal preference of the player. More specifically, the golf club system includes a telescoping club shaft with a variable length to facilitate adjusting a overall length of the golf club, replaceable hosels for visual aesthetics, and an adjustment assembly coupled to the club shaft and the club head to enable an orientation of the club head to be adjusted with respect to the club shaft to modify a lie angle of the club head and an orientation of the club face with respect to the player. By providing an adjustable golf club system a player is able to adjust the overall club length and lie angle based on a change in the stance, swing path, and personal preferences of the player over time, thus increasing the useful life of the golf club.

In general, the adjustable golf club system 10 includes an Infinit Chamber that is designed to allow infinite possibilities for putter lie angles and shaft/grip position, and a sliding mechanism to give putter unlimited positions to allow putters to be used by right-handed or left-handed players. A putter face is designed to be heel and toe balanced and allows the putter to be used right-handed or left-handed. An interchangeable sliding key is provided to allow the putter head to be interchangeable to give a traditional look or a complete custom look. The head designs can range from mallets, traditional, blades in addition to custom design heads. The sliding key provides a secured interlocking track that gives the putter a solid feel upon attaching the back side of the putter head. The putter head includes an interchangeable backing that allows putter to be a mallet, Blade, Traditional or Custom Putter Head. The system also includes an interchangeable hosel that can be interchangeable to suit golfers' preferences. The hosel includes attaching point at bottom of the hosel that will be secured to putter head with a lie locking bolt. The hosel will attach to the club shaft at the top of the hosel with a lie adjusted clamp and shaft expansion bolt. A shaft connection sleeve (male) allows the putter shaft to secure to putter head, slides over shaft tip and screws into internal locking mechanism. A threaded exterior of shaft connection sleeve allows a shaft connection cap to securely thread and lock shaft in place. The internal locking mechanism slides inside of the shaft, allows the shaft connection sleeve to thread on the exterior of internal locking mechanism, and provides a port for exploding pressure from the inside of the shaft, allows a shaft expansion bolt to thread inside and place pressure and friction along the inner walls of the shaft, and may fit inside of any shaft size from 0.370 to 0.395 diameter.

The shaft connection cap (female) slides over the shaft connection sleeve and secures the club shaft to the hosel. The shaft connection cap provides pressure towards the exterior diameter of the shaft and allows the hosel to be interchangeable without using adhesive or epoxy. A shaft expansion bolt threads inside the internal locking mechanism. Once inside the club shaft, the golfer may tighten with a shaft locking bolt. As the shaft locking bolt is being tightened, the shaft expansion bolt is expanding the tip of internal locking mechanism causing pressure to which will provide a secure wedge fit against the inside of the putter shaft. The shaft locking bolt screws into the center of the internal locking mechanism connecting the shaft to the hosel. The shaft locking bolt has same hex configuration as other bolts in the system design. A locking barrel sliding member is provided to absorb the weight of the hosel to allow for a solid feel during the putting stroke. The barrel slides from heel to toe inside of the Infinit Chamber and has the ability to add weight on either side of it. Balancing weights made of tungsten and/or rubber are designed to add weight as needed to counter balance putter head/shaft weight as it is interchanged. The weights will vary in weight amount and will have the ability to add to each other filling up the Infinit Chamber. A washer bolt allows a lie locking bolt to secure to putter face for added strength. the lie locking bolt is spring loaded to allow resistance during loosening and can be tightened once golfer adjust the putter lie to the angel that golfer chooses. The lie locking bolt goes thru the interchangeable hosel opening and securely into the locking barrel. The locking bolt may be accessed using a using an Infinit Key. Rear locking bolts secure the interchangeable backing to the putter face utilizing the interchangeable sliding key. Rear locking bolts are locked by turning Infinit Key clockwise. The Infinit Key is provided with the putter to tighten and loosen interchangeable parts within the putter. A small key may be used for the rear locking bolts. A large key may be used for the loft locking bolt and the shaft locking bolt.

In one embodiment, the adjustable golf club system 10 includes a golf club that includes a club shaft, an adjustable club head, a hosel that is removably coupled between the club shaft and the club head, and an adjustment assembly that is coupled to the hosel and the club head to facilitate adjusting the orientation of the club head with respect to the club shaft. The club shaft includes a telescoping body that enables the overall length of the club shaft to be adjusted based on the height and stance of the player using the club. In addition, the adjustment assembly enables the orientation of the club head to be modified with respect to the club shaft to facilitate adjusting the lie angle of the club face based on the stance, stroke, and swing path of the player. In addition the adjustment assembly enables a player to modify the orientation of the club shaft with respect to the club face such that the golf club may be used by both right-handed and left-handed players. In addition, the adjustable golf club system 10 also includes a replaceable hosel to enable a player to replace the hosel used within the golf club system to adjust an orientation of the club head with respect to a centerline axis of the club shaft or for visual aesthetics, and to adjust the overall length of the golf club. Moreover, the club head includes one or more removable weighed plates that allows a player to adjust the weight of the club head by adding or removing the weighted plates from the club head. This allows the golfer to enhance their swing path (i.e. straight back/straight thru or inside/out, etc.).

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Figure 2:
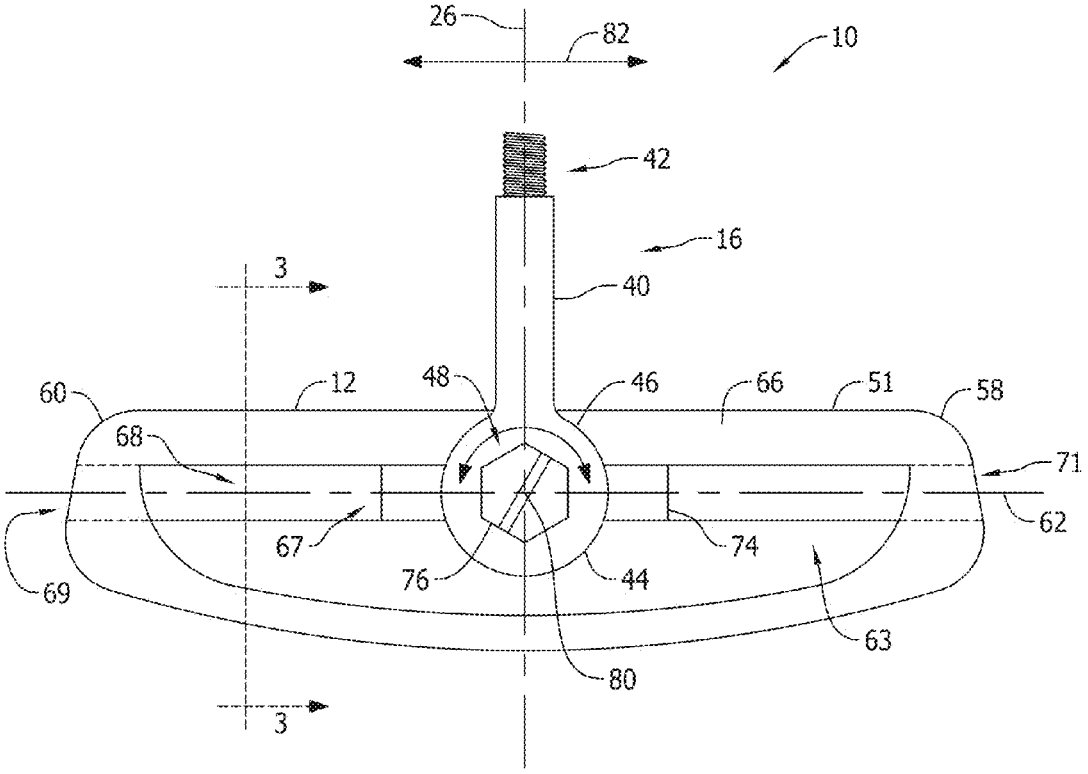
FIG. 2 is a rear view of a portion of the adjustable golf club system shown in FIG. 1; according to an embodiment of the present invention.
Figure 3:
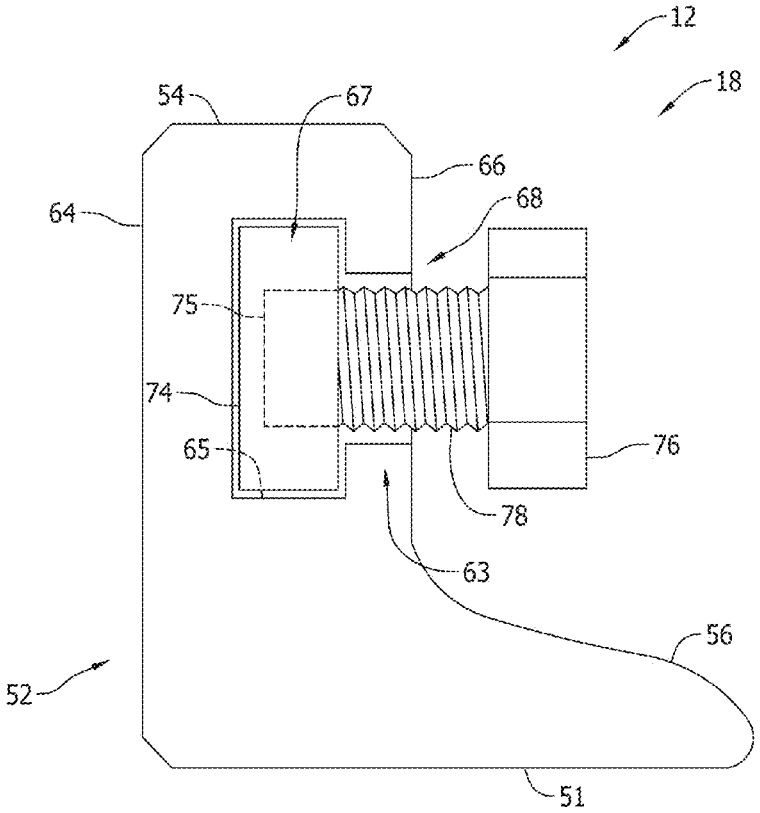
FIG. 3 is a sectional view of the adjustable golf club system shown in FIG. 2 and taken along section line 3-3.
Figure 4:
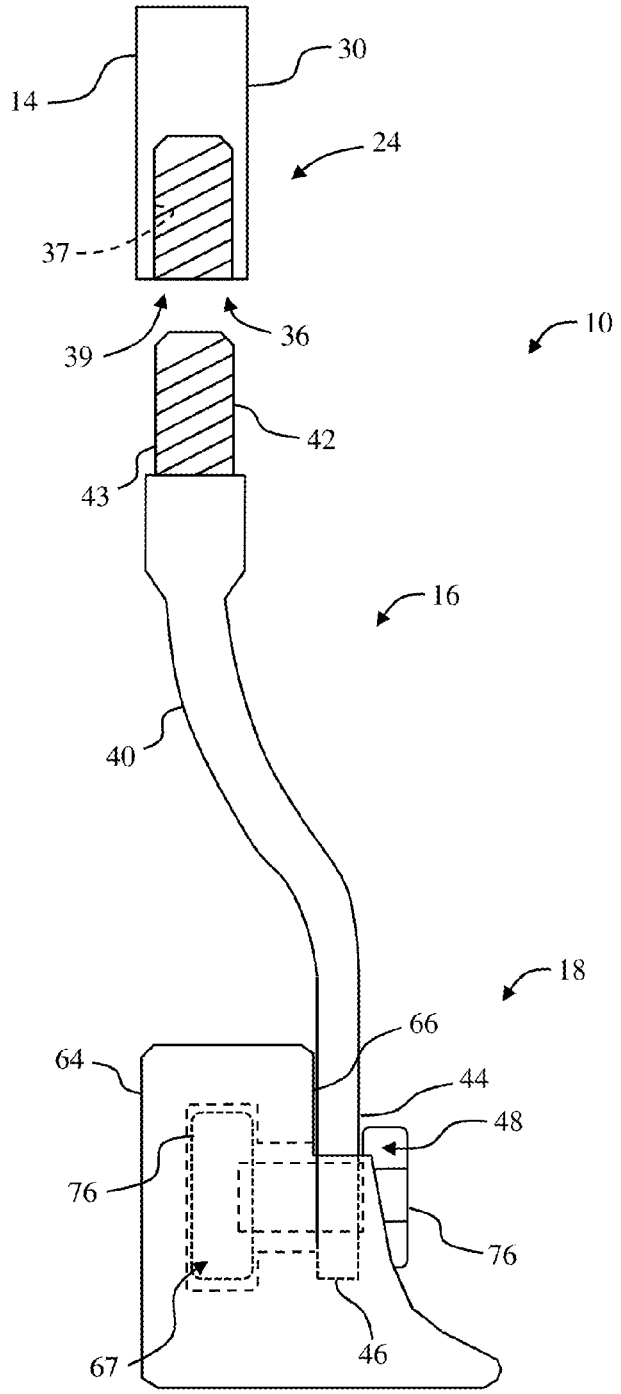
FIG. 4 is a schematic view of the adjustable golf club system shown in FIG. 1 and taken along area 4.
Figure 5:
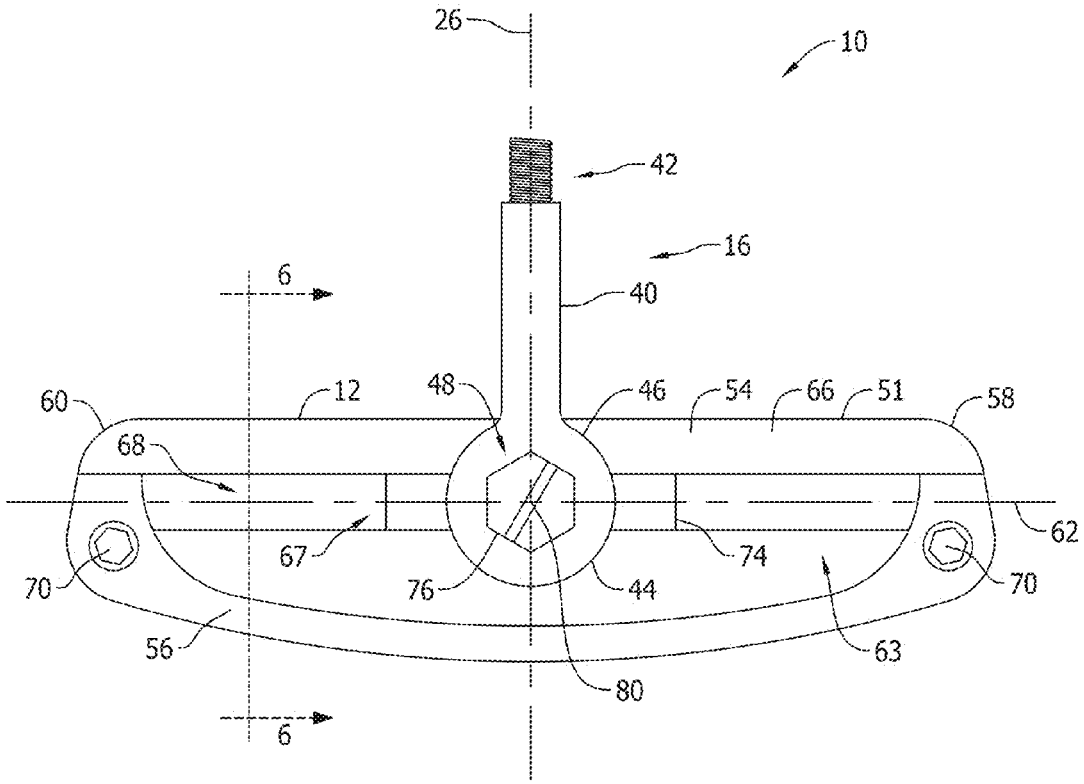
FIG. 5 is another rear view of the adjustable golf club system shown in FIG. 1, according to an embodiment of the present invention.
Figure 6:
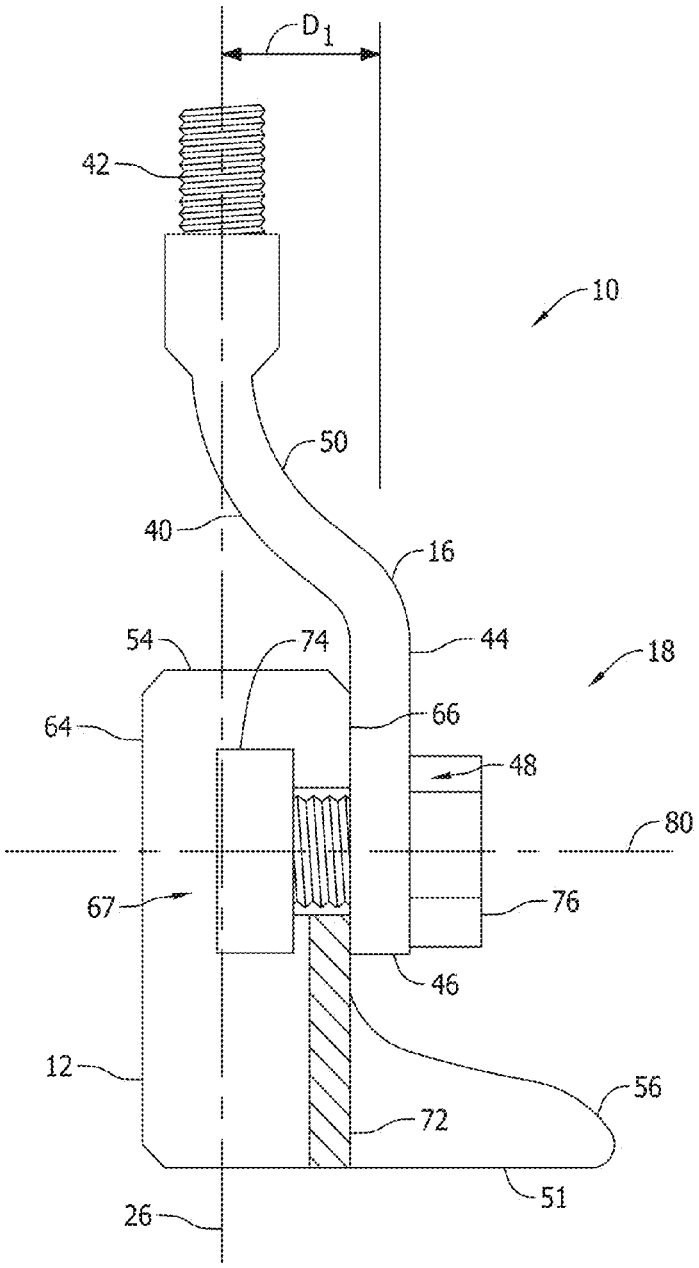
FIG. 6 is a sectional view of the adjustable golf club system shown in FIG. 5 and taken along section line 6-6.
Figure 7:
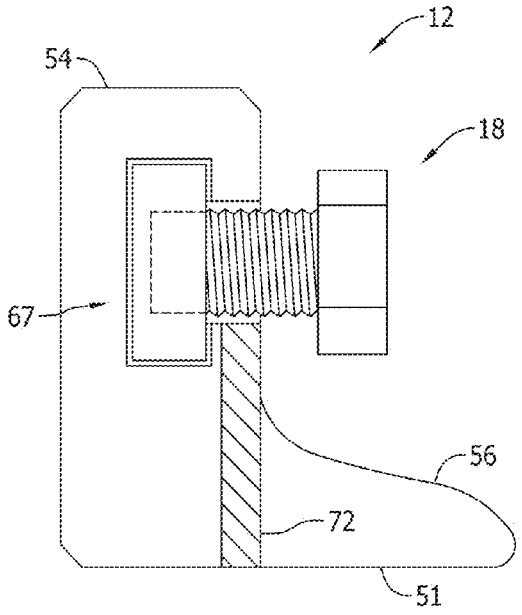
FIG. 7 is another sectional view of the adjustable golf club system in FIG. 6.
Figure 8:
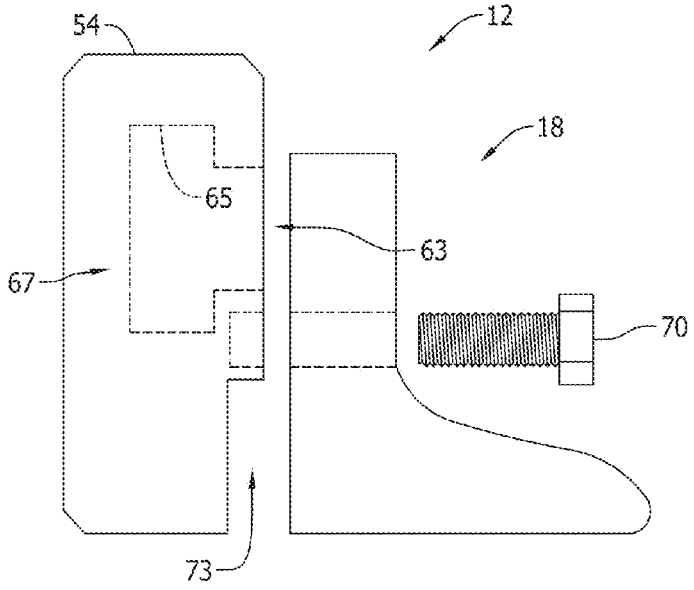
FIG. 8 is an exploded sectional view of the adjustable golf club system shown in FIG. 7.
Figure 9:
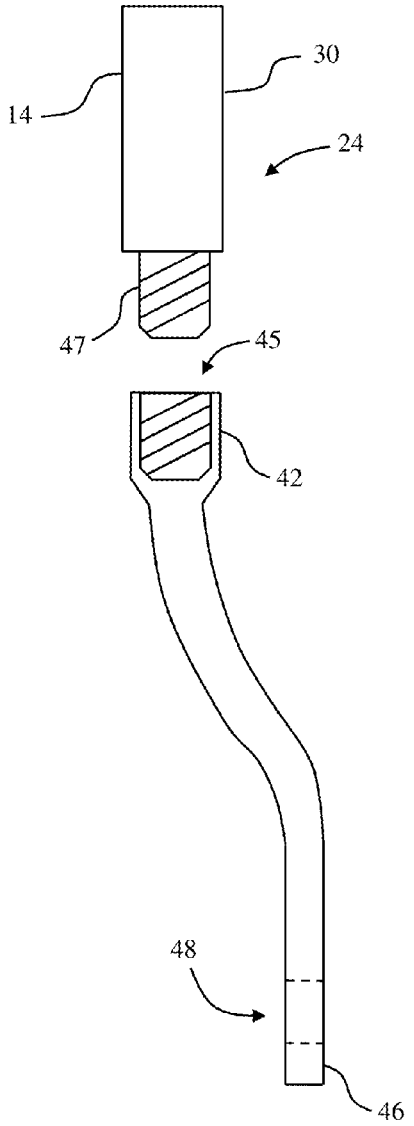
FIG. 9 is a schematic view of a portion of the adjustable golf club system shown in FIG. 4, according to an embodiment of the present invention.
Figure 10:
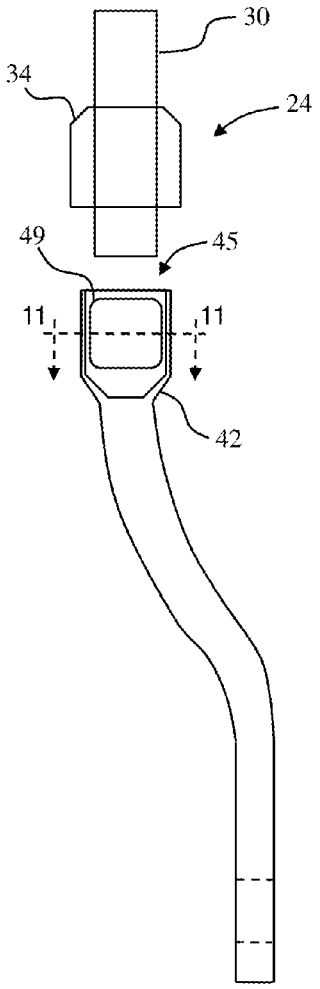
FIG. 10 is another schematic view of a portion of the adjustable golf club system shown in FIG. 4, according to an embodiment of the present invention.
Figure 11:
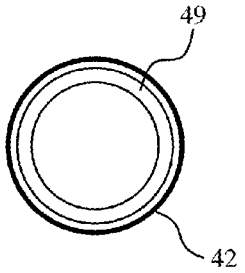
FIG. 11 is a sectional view of a portion of the adjustable golf club system shown in FIG. 10 and taken along section line 11-11.
Figure 12:
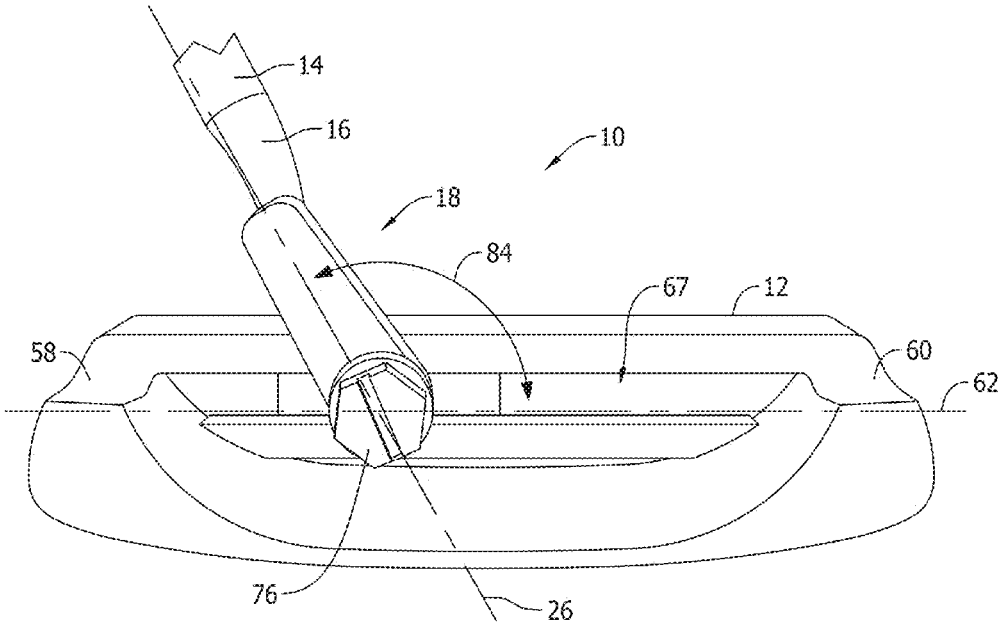
FIGS. 12 and 13 are enlarged perspective views of the adjustable golf club system shown in FIG. 1, according to an embodiment of the present invention.
Figure 13:
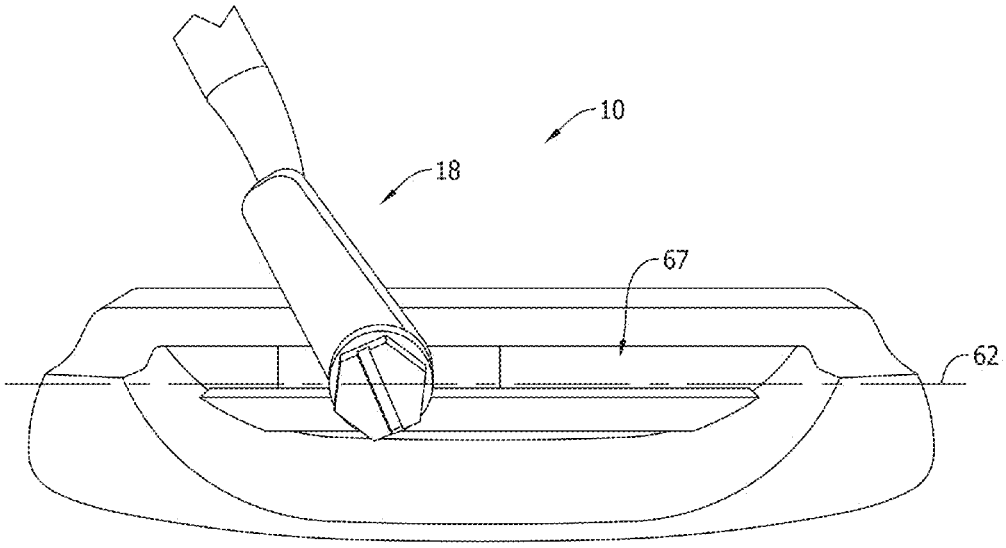
Figure 14:
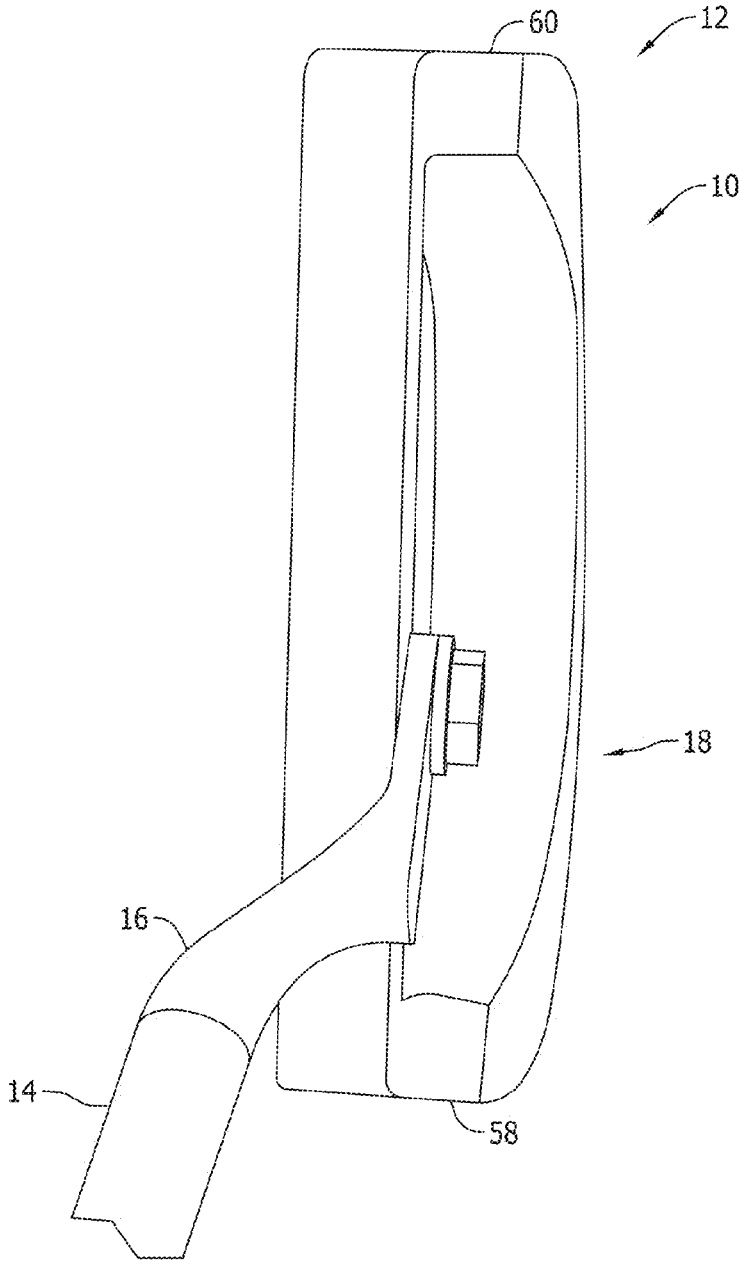
FIG. 14 is a top view of a portion of the adjustable golf club system shown in FIG. 1, according to an embodiment of the present invention.

FIG. 1 is a perspective view of the adjustable golf club system 10, according to an embodiment of the present invention. FIG. 2 is a rear view of a portion of the adjustable golf club system 10. FIG. 3 is a sectional view of the adjustable golf club system 10 taken along section line 3-3 in FIG. 2. FIG. 4 is a sectional view of the adjustable golf club system 10 taken along area 4 in FIG. 1. FIG. 5 is another rear view of the adjustable golf club system 10, according to an embodiment of the present invention. FIG. 6 is a sectional view of the adjustable golf club system 10 taken along section line 6-6 in FIG. 5. FIG. 7 is another sectional view of the adjustable golf club system 10. FIG. 8 is an exploded sectional view of a portion of the adjustable golf club system 10. FIGS. 9 and 10 are schematic views of a portion of the adjustable golf club system 10. FIG. 11 is a sectional view of a portion of the adjustable golf club system 10 taken along section line 11-11 in FIG. 10. FIGS. 12-14 are enlarged perspective views of the adjustable golf club system 10.

In the illustrated embodiment, the adjustable golf club system 10 includes a club head 12, a club shaft 14, a hosel 16, and an adjustment assembly 18 that is coupled to the hosel 16 and the club head 12 to facilitate adjusting an orientation of the club head 12 with respect to the club shaft 14. The club shaft 14 includes a telescoping shaft body 20 that extends between a first end 22 and a second end 24 and has a length $L_1$ measured along a centerline axis 26 between the first end 22 and the second end 24. The shaft body 20 includes an upper section 28 and a lower section 30 that is rotatably coupled to the upper section 28. The upper section 28 includes an inner surface 31 that defines a shaft cavity 32 therein. The shaft cavity 32 is configured to receive a portion of the lower section 30 therein. The lower section 30 includes a threaded outer surface 33 that is configured to engage a corresponding threaded portion of the inner surface 31 of the upper section 28. The upper section 28 is adapted to rotate with respect to the lower section 30 such that a rotation of the upper section 28 in a first direction increases the length of the shaft body 20, and a rotation of the upper section 28 in an opposite second direction decreases the overall length of the shaft body 20. The upper section 28 also includes a locking collar 34 that is configured to engage the outer surface of the lower section 30 to facilitate coupling the upper section 28 to the lower section 30 via a friction fit formed between the locking collar 34 and the outer surface of the lower section 30. The lower section 30 includes a recessed portion 36 that is defined at the club shaft second end 24. The recessed portion 36 includes an inner surface 37 that defines an interior chamber 39 that is configured to receive a portion of the hosel 16 therein. The club shaft 14 also includes a grip 38 that is coupled to an outer surface of the upper section 28 to facilitate a player grasping the club shaft 14.

In the illustrated embodiment, the hosel 16 includes a body 40 that extends between a first end 42 and a second end 44. The hosel first end 42 includes a threaded outer surface 43 that is configured to be inserted into the interior chamber 39 of the shaft lower section recessed portion 36. The threaded outer surface of the hosel first end 42 is configured to engage a corresponding threaded portion of the interior chamber 39 to coupled the club shaft 14 to the hosel 16. Referring to FIG. 9, in one embodiment the hosel first end 42 may include a hosel recessed portion 45. The shaft lower section 30 may include a threaded protection 47 that is configured to engage a corresponding threaded section defined within the hosel recessed portion 45. Referring to FIGS. 10 and 11, the system 10 may include an O-ring gasket 49 that is positioned within the hosel recessed portion 45 and is sized and shaped to receive the club shaft 14 therein to facilitate forming a friction fit between the hosel first end 42 the O-ring gasket 49, and the club shaft 14. A locking collar 34 may be used to engage the outer surface of the hosel 16 and the club shaft 14 to facilitate coupling the hosel 16 to the club shaft 14.

In the illustrated embodiment, the hosel second end 44 includes a fastener head 46 that is adapted to be coupled to the adjustment assembly 18. The fastener head 46 includes a fastener opening 48 that extends through the fastener head 46 and is sized and shaped to receive a portion of the adjustment assembly 18 therethrough. In the illustrated embodiment, the hosel 16 includes an arcuate outer surface 50 such that the hosel second end 44 is offset a distance $D_1$ from the hosel first end 42 with respect to the centerline axis 26. In addition, the hosel 16 is removably coupled to the club shaft 14 and the club head 12 to enable a plurality of hosels 16, each having a different length between the first end 42 and the second end 44 and a different offset distance $D_1$, to be used with the adjustable golf club system 10. By providing a system 10 that accommodates various hosel 16 designs, the offset distance of the club head 12 from the club shaft 14 may be modified.

In the illustrated embodiment, the club head 12 includes a putter head 52. In another embodiment, the club head 12 may include any suitable golf club head having any suitable club face angle. The club head 12 includes a body 51 having a forward member 54 and an aft member 56. In one embodiment, the body 51 is unitarily formed (shown in FIGS. 2-4). In another embodiment, the aft member 56 is removably coupled to the forward member 54 to form the body 51 (shown in FIGS. 5-8). In the illustrated embodiment, the forward member 54 extends between a heel portion 58 and a toe portion 60 along a longitudinal axis 62, and includes a front club face 64 and a rear club face 66. The front club face 64 and the rear club face 66 each extend between the heel portion 58 and the toe portion 60. A recessed portion 63 is defined within the forward member 54 and extends along the rear club face 66 between the heel portion 58 and the toe portion 60 along the longitudinal axis 62. The recessed portion 63 includes a slot 68 that is defined along the rear club face 66 and has an inner surface 65 that defines a club head cavity 67 that extends between the toe portion 60 and the heel portion 58 along the longitudinal axis 62. In one embodiment, the club head cavity 67 may have a substantially rectangular shape (shown in FIGS. 3 and 4). In another embodiment, the club head cavity 67 may have a substantially cylindrical shape (shown in FIGS. 15-19). In one embodiment, the forward member 54 may also include a toe opening 69 defined along an outer surface of the toe portion 60 and/or a heel opening 71 defined along an outer surface of the heel portion 58 to provide access to the club head cavity 67 through the toe portion 60 and/or the heel portion 58, respectively. The toe opening 69 and/or the heel opening 71 may be sized and shaped to receive a portion of the adjustment assembly 18 therethrough to facilitate positioning the adjustment assembly 18 within the club head cavity 67.

In one embodiment, the aft member 56 may be coupled to the forward member 54 with a plurality of screws 70 that are coupled to the heel portion 58 and the toe portion 60, respectively. In the illustrated embodiment, the club head 12 also includes one or more removable weighted plates 72 that are coupled between the aft member 56 and the forward member 54 for adjusting an overall weight of the club head 12. Moreover, the weighted plates 72 are coupled to the forward member 54 and the aft member 56 with the screws 70. In one embodiment, the aft member 56 and/or the forward member 54 may include one or more grooves 73 that are sized and shaped to receive one or more weighted plates 72 therein. In another embodiment, the weighted plates 72 may be positioned between the aft member 56 and the forward member 54. In the illustrated embodiment, the player may adjust the overall weight of the club head 12 by adding or removing weighted plates 72 from the club head 12. More specifically, the player removes the screws 70 from the club head 12 to access the weighted plates 72, positions a desired number of weighted plates 72 between the forward member 54 and the aft member 56, and replaces the screws 70 to couple the forward member, the aft member 56, and the weighted plates 72 together.

In the illustrated embodiment, the adjustment assembly 18 includes a sliding member 74 and a hosel fastener 76 that is removably coupled to the sliding member 74 to facilitate coupling the hosel 16 to the sliding member 74 and the club head 12. The club head cavity 67 is sized and shaped to receive the sliding member 74 therein to enable the sliding member 74 to be positioned at any location along the longitudinal axis 62 within the club head cavity 67. The sliding member 74 includes an opening 75 that is sized and shaped to receive the hosel fastener 76 therein to facilitate coupling the hosel fastener 76 to the sliding member 74. In the illustrated embodiment, the adjustment assembly 18 also includes a spring 78 that is positioned about an outer surface of the hosel fastener 76. The spring 78 is adapted to contact the hosel fastener 76 and the sliding member 74 to bias the hosel fastener 76 outwardly from the sliding member 74 to facilitate decoupling the hosel 16 from the club head 12. In the illustrated embodiment, the hosel fastener 76 is inserted through the hosel fastener head opening 48 to pivotably couple the hosel 16 to the club head 12. More specifically, the hosel fastener 76 extends through the fastener head 46 and is coupled to the sliding member 74 such that a pivot point 80 is defined through the hosel fastener 76 to enable the hosel 16 to pivot with respect to the club head 12 about the pivot point 80. In one embodiment, the hosel fastener 76 may be a screw. Alternatively, the hosel fastener 76 may be any suitable attachment assembly that enables the adjustment assembly 18 to function as described herein.

During operation, in the illustrated embodiment, a player will operate the adjustment assembly 18 to move the sliding member 74 in a direction 82 along the longitudinal axis 62 to position the hosel second end 44 at a desired location with respect to the club head 12. The player may also rotate the hosel 16 about the pivot point 80 to adjust the hosel 16 to a desired lie angle 84 that is defined between the longitudinal axis 62 and the centerline axis 26 of the club shaft 14. Upon positioning the hosel 16 at the desired position and lie angle 84 the player tightens the hosel fastener 76 to secure the hosel 16 to the club head 12. By providing an adjustment assembly 18 that enables a player to adjust an orientation of the club shaft 14 with respect to the club head 12, the player may adjust the lie angle 84 of the club head 12 and adjust the orientation of the club face 64 with respect to the player to enable the adjustable golf club system 10 to be used by left-handed and right-handed players.

Figure 15:
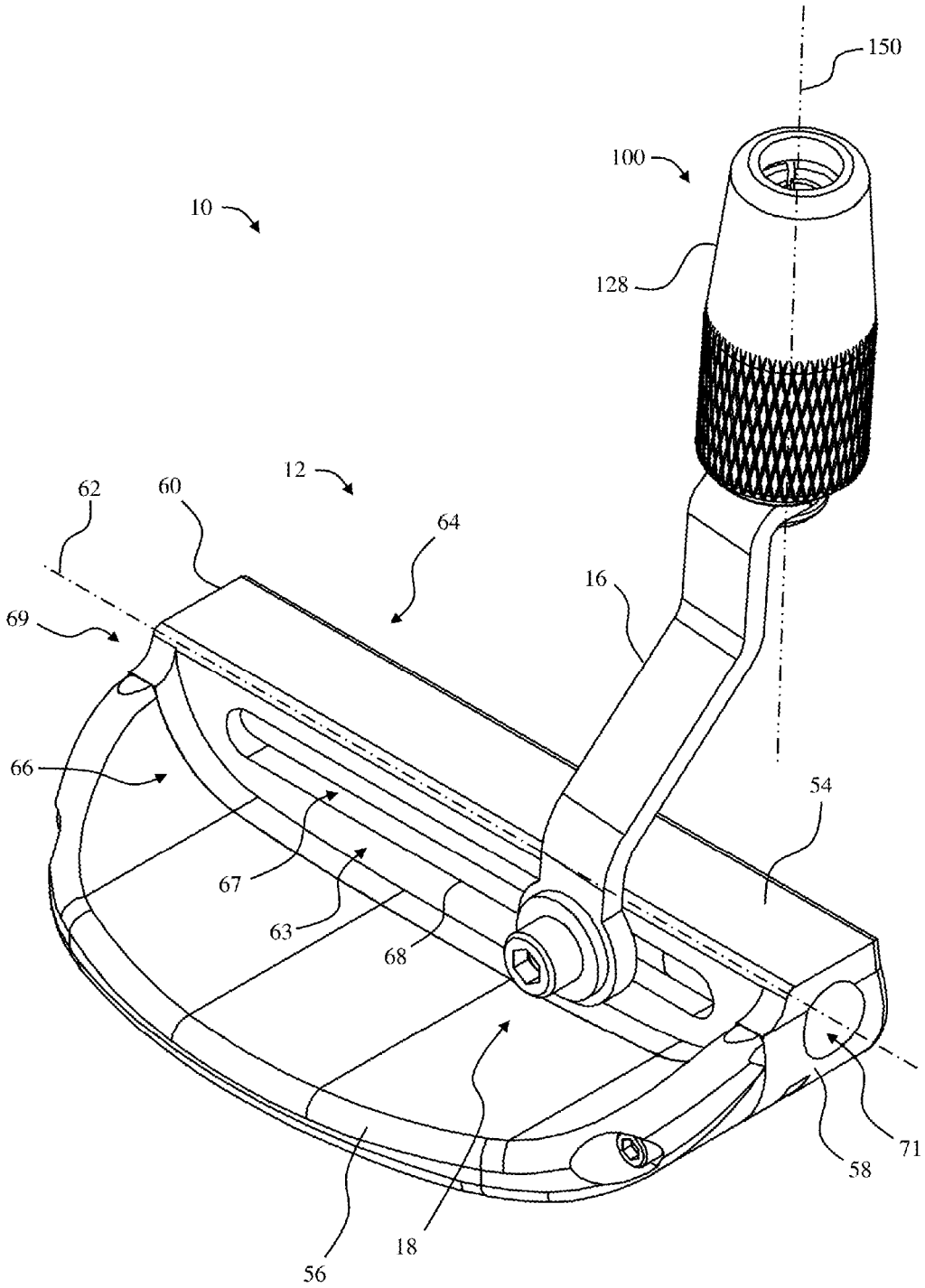
FIG. 15 is a perspective view of a portion of the adjustable golf club system shown in FIG. 1, according to an embodiment of the present invention.
Figure 16:
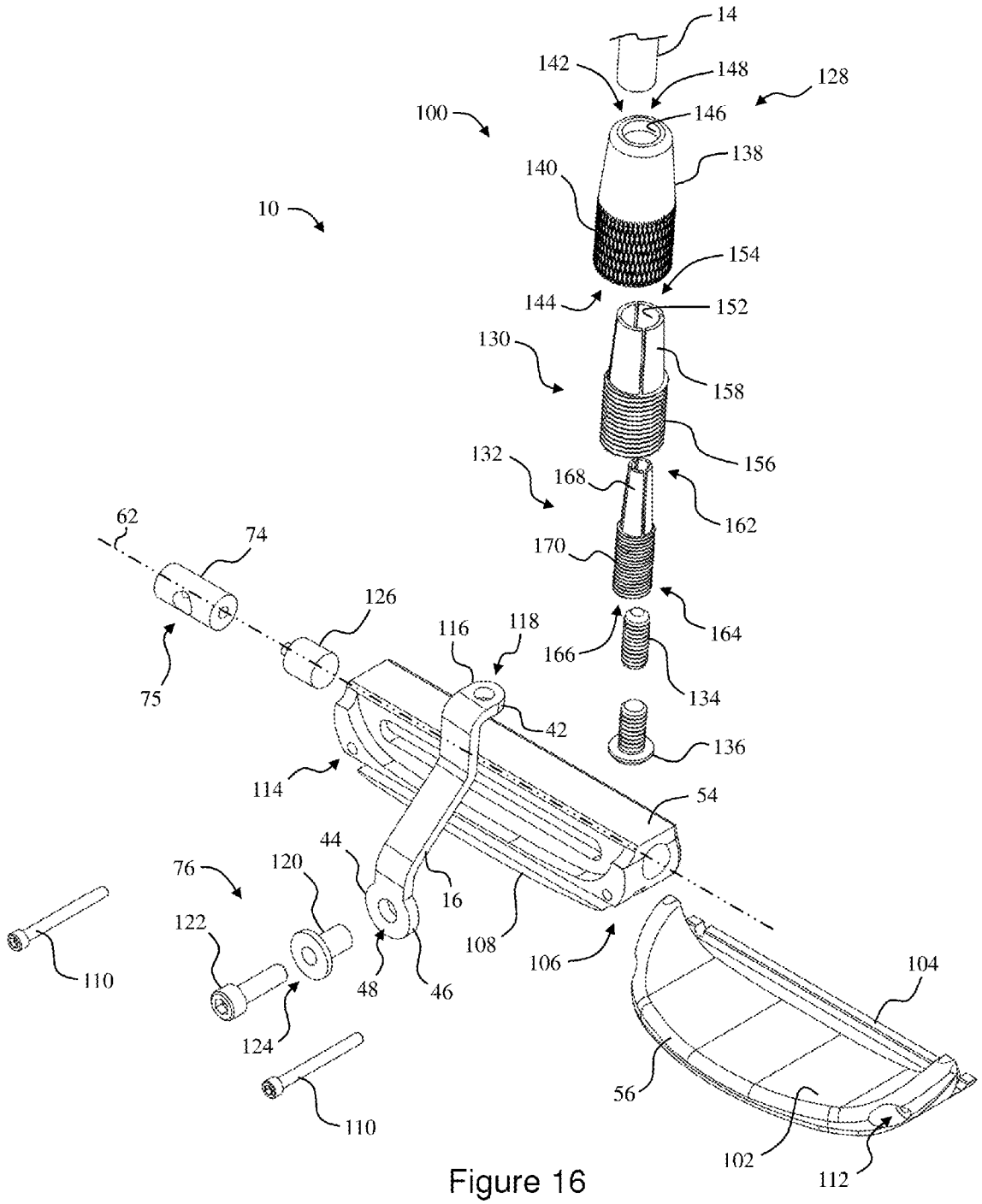
FIG. 16 is an exploded schematic view of the adjustable golf club system shown in FIG. 15.
Figure 17:
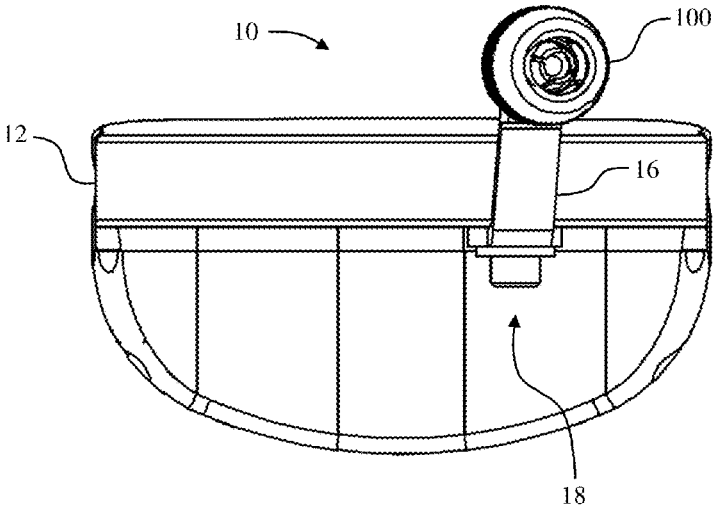
FIG. 17 is a top view of the adjustable golf club system shown in FIG. 15.
Figure 18:
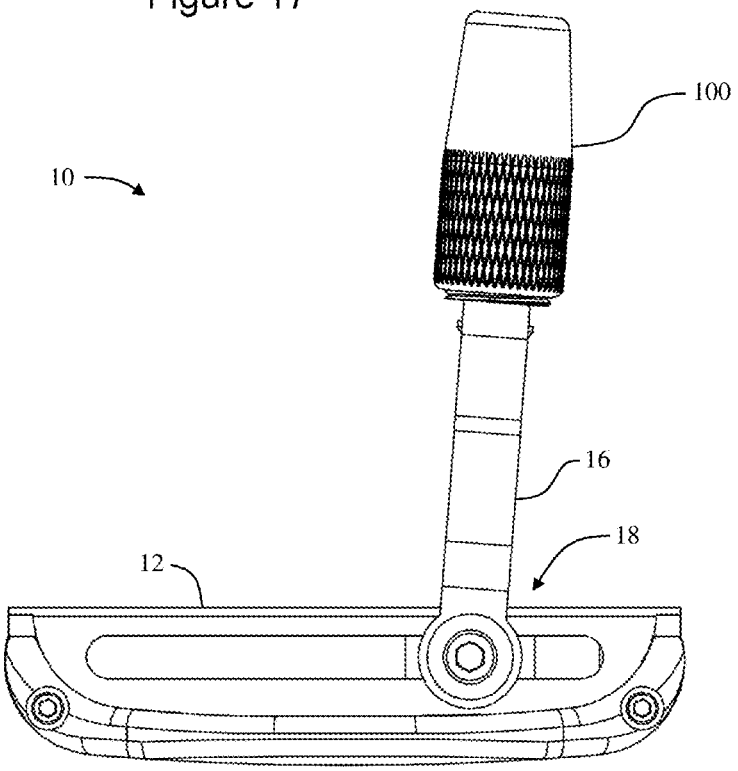
FIG. 18 is a rear view of the adjustable golf club system shown in FIG. 15.
Figure 19:
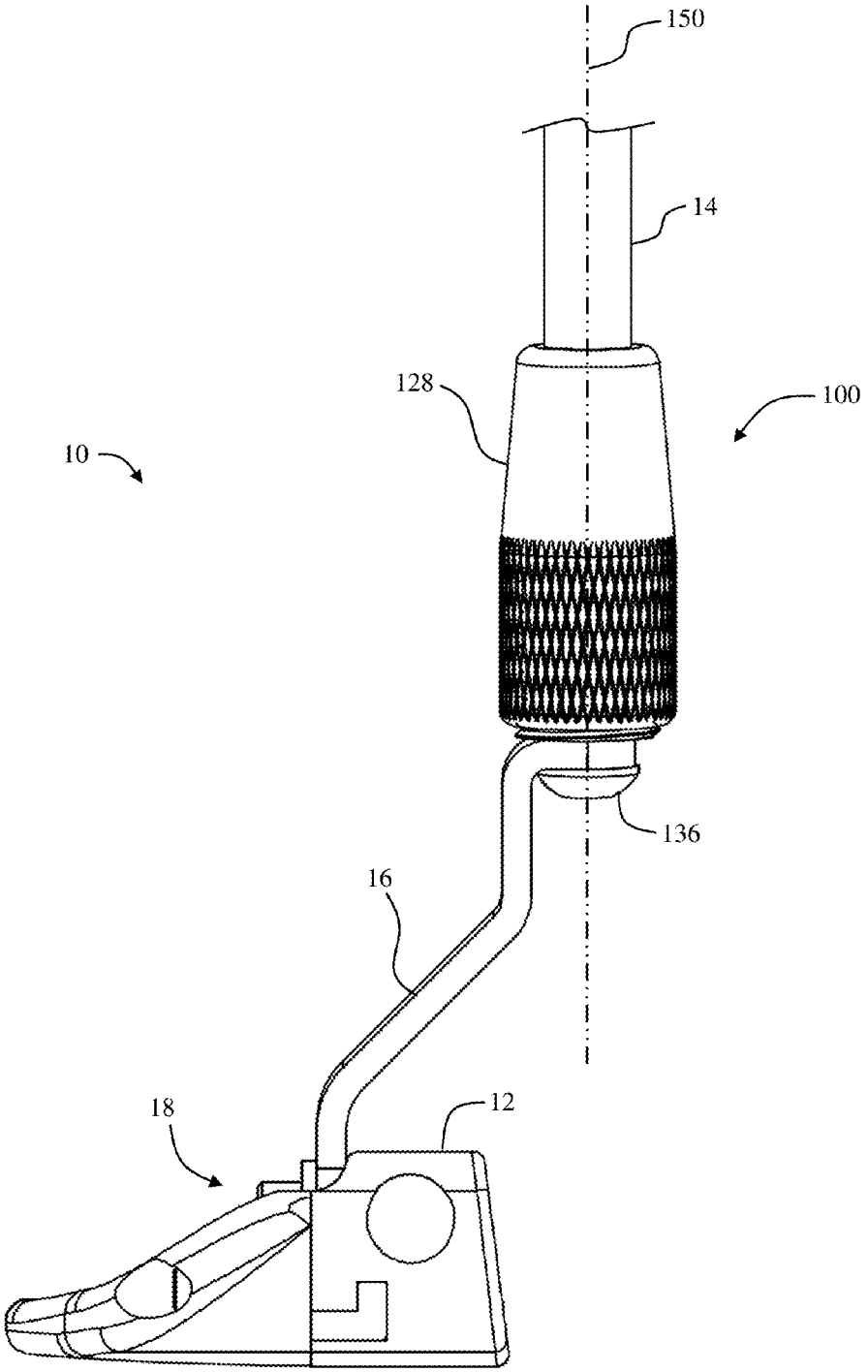
FIG. 19 is a side view of the adjustable golf club system shown in FIG. 15.

FIG. 15 is another perspective view of a portion of the adjustable golf club system 10, according to an embodiment of the present invention. FIG. 16 is an exploded schematic view of the adjustable golf club system 10 shown in FIG. 15. FIGS. 17-19 are various views of the adjustable golf club system 10. In the illustrated embodiment, the adjustable golf club system 10 includes the club head 12, the hosel 16, the adjustment assembly 18 that is coupled to the club head 12 and the hosel 16, and a shaft attachment assembly 100 that is coupled between the hosel 16 and the club shaft 14 to facilitate removably coupling the club shaft 14 to the hosel 16.

The club head 12 includes the body 51 including the front club face 64 and the opposite rear club face 66. The front club face 64 and the rear club face 66 each extend between the toe portion 60 and the heel portion 58 along the longitudinal axis 62. The recessed portion 63 is defined along the rear club face 66 and has an inner surface 65 that defines the club head cavity 67. The club head cavity 67 extends between the toe portion 60 and the heel portion 58 along the longitudinal axis 62 and includes a substantially cylindrical shape. In the illustrated embodiment, the club head 12 includes a toe opening 69 defined along an outer surface of the toe portion 60 to provide access to the club head cavity 67. The toe opening 69 is configured to receive the sliding member 74 therethrough to enable the sliding member 74 to be inserted through the toe opening 69 and into the club head cavity 67. In one embodiment, the club head 12 may also include the heel opening 71 defined along an outer surface of the heel portion 58 and sized to receive the sliding member 74 therethrough.

In the illustrated embodiment, the club head 12 includes the forward member 54 and the aft member 56 that is removably coupled to the forward member 54. The forward member includes the club head cavity 67 defined therein. The aft member 56 includes an outer surface 102 and a projection 104 that extends outwardly from the aft member outer surface 102 and orientated substantially parallel to the longitudinal axis 62. The forward member 54 includes a groove 106 that is defined within an outer surface 108 of the forward member 54 and that extends between the toe portion 60 and the heel portion 58. The groove 106 is sized and shaped to receive the projection 104 therein to facilitate coupling the aft member 56 to the forward member 54. The club head 12 may also include a pair of head locking bolts 110 to removably couple the aft member 56 to the forward member 54. Each head locking bolt 110 is inserted through corresponding opening 112 that extends through the aft member 56 and is received in a corresponding bolt hole 114 defined within the forward member 54. Each head locking bolt 110 may include a recessed portion having an hexagonal shape to sized and shaped to received a tool (not shown) therein to enable a use to rotate the head locking bolt 110 to facilitate coupling the aft member 56 to the forward member 54.

In the illustrated embodiment, the hosel 16 includes the first end 42 and the opposite second end 44. The first end 42 includes a shaft connection head 116 that is adapted to be coupled to the club shaft 14 and includes a shaft opening 118 that extends through the shaft connection head 116. The shaft opening 118 is configured to receive a portion of the shaft attachment assembly 100 therethrough to facilitate coupling the hosel 16 to the club shaft 14. The second end 44 includes the fastener head 46 having a fastener opening 48 that extends through the fastener head 46. In the illustrated embodiment, the shaft opening 118 is orientated within a first coordinate plane and the fastener opening 48 orientated is within a second coordinate plane that is perpendicular to the first coordinate plane.

The adjustment assembly 18 is removably coupled to the club head 12 and the hosel 16 to facilitate adjusting an orientation of the hosel 16 with respect to the club head 12. In the illustrated embodiment, the adjustment assembly 18 includes the sliding member 74 and the hosel fastener 76 that is removably coupled to the sliding member 74. The sliding member 74 includes a substantially cylindrical shape and is positioned within the club head cavity 67 and movable along the longitudinal axis 62 between the toe portion 60 and the heel portion 58. The hosel fastener 76 extends through the fastener head 46 towards the sliding member 74 to contact an outer surface of the fastener head 46 to couple the hosel 16 to the club head 12.

In the illustrated embodiment, the hosel fastener 76 includes a washer bolt 120 and a hosel locking bolt 122. The washer bolt 120 extends through the fastener head 46 towards the sliding member 74 and includes a center cavity 124 that extends through the washer bolt 120. The hosel locking bolt 122 is inserted through the center cavity 124 and extends through the washer bolt 120 towards the sliding member 74. The sliding member 74 includes a threaded recessed hole 75 that is sized and shaped to receive a corresponding threaded portion of the hosel locking bolt 122 therein to facilitate coupling the hosel second end 44 to the club head 12. In one embodiment, the hosel locking bolt 122 may include a recessed portion having an hexagonal shape to sized and shaped to received a tool (not shown) therein to enable a use to rotate the hosel locking bolt 122 to facilitate coupling the hosel 16 to the club head 12.

A balancing weight 126 is coupled to the sliding member 74 and includes an outer surface having a shape that is configured to be received within the club head cavity 67. In one embodiment, the system 10 may include a pair of balancing weights 126 that are coupled to opposing ends of the sliding member 74.

In the illustrated embodiment, the shaft attachment assembly 100 includes a shaft connection cap 128, a shaft connection sleeve 130 adapted to be positioned within the shaft connection cap 128, and an internal locking device 132 that is configured to be inserted within the shaft connection sleeve 130. In addition, the shaft attachment assembly 100 includes an expansion bolt 134 and a shaft locking bolt 136 each of which are configured to be inserted within the internal locking device 132.

The shaft connection cap 128 includes an upper portion 138 and a lower portion 140. The upper portion 138 includes a first open end 142. The lower portion 140 includes a second open end 144. The shaft connection cap 128 also includes an inner surface 146 that defines a connection cap cavity 148 that extends between the first open end 142 and the second open end 144 along a centerline axis 150. The connection cap cavity 148 is sized and shaped to receive the club shaft 14 therein through the first open end 142. In the illustrated embodiment, the first open end 142 has a first diameter and the second open end 144 has a second diameter that is larger than the first diameter such that the upper portion 138 has a substantially frustoconical shape converging from the lower portion towards the first open end 142.

The shaft connection sleeve 130 is positioned within the connection cap cavity 148 and extends through the second open end 144. The shaft connection sleeve 130 includes an inner surface 152 that defines an interior cavity 154 that extends through the shaft connection sleeve 130 and is sized and shaped to receive the club shaft 14 therein. The shaft connection sleeve 130 includes a base member 156 and a plurality of clamping members 158 that extend outwardly from the base member 156 along the centerline axis 150. The clamping members 158 are orientated and spaced about the centerline axis 150. The base member 156 has a threaded outer surface that is configured to engage a corresponding threaded portion of the inner surface 146 of the shaft connection cap 128 to rotatably couple the shaft connection sleeve 130 to the shaft connection cap 128. The inner surface 146 of the shaft connection cap 128 is configured to contact the clamping members 158 to bias the clamping members 158 towards the club shaft 14 to contact an outer surface of the club shaft 14 to facilitate forming a friction fit between the clamping members 158 and the club shaft 14. Moreover, the shaft connection cap 128 extends over a portion of the outer surface of the shaft connection sleeve 130 to contact the corresponding threaded outer surface of the base member 156. As the shaft connection cap 128 is rotated about the centerline axis 150, the shaft connection cap 128 is moved towards the base member 156 allowing the upper portion 138 of the shaft connection cap 128 to contact the clamping member 158 to form a friction fit between the shaft connection cap 128, the clamping members 158, and the club shaft 14.

The internal locking device 132 includes an inner surface that extends between a top end 162 and a bottom end 164 and defines an expansion cavity 166 that extends between the top end 162 and the bottom end 164 along the centerline axis 150. The internal locking device 132 also includes a plurality of expansion members 168 that extend outwardly from a main body 170 along the centerline axis 150. The expansion members 168 are orientated about the centerline axis 150 and define an outer surface of the internal locking device 132 that is sized and shaped to be inserted within an interior chamber 39 of the club shaft 14. The main body 170 includes a threaded outer surface that is configured to engage a corresponding threaded portion of the inner surface of the shaft connection sleeve 130.

The expansion bolt 134 is configured to be inserted within the expansion cavity 166 and to contact the expansion members 168 to bias the expansion members 168 outwardly towards the inner surface of the club shaft 14 as the expansion bolt 134 is moved along the centerline axis 150 and towards the club shaft 14. The shaft locking bolt 136 is configured to be inserted through the bottom end 164 of the internal locking device 132 and within the expansion cavity 166 to contact the expansion bolt 134 to move the expansion bolt 134 along the centerline axis 150 and towards the top end 162 of the internal locking device 132. The shaft locking bolt 136 also includes a threaded outer surface that is configured to engage a corresponding threaded portion of the inner surface of the internal locking device 132 to rotatably couple the shaft locking bolt 136 to the internal locking device 132.

In the illustrated embodiment, the shaft locking bolt 136 extends through the shaft opening 118 defined in the hosel shaft connection head 116 and contacts the shaft connection head 116 to coupled the hosel 16 to the shaft attachment assembly 100 and the club shaft 14.

Exemplary embodiments of an adjustable golf club system are described above in detail. The apparatus is not limited to the specific embodiments described herein, but rather, components of the apparatus may be utilized independently and separately from other components and/or steps described herein. For example, the apparatus may also be used in combination with other golf club systems, and are not limited to practice with only the golf club system as described herein. Rather, the exemplary embodiment can be implemented and utilized in connection with many other applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention may be practiced with modification within the spirit and scope of the claims.

What is claimed is:

1. An adjustable golf club system comprising:

a club shaft;

a club head including:

a body including a front club face and an opposite rear club face, each of the front club face and the rear club face extending between a toe portion and a heel portion along a longitudinal axis; and a recessed portion defined along the rear club face, the recessed portion having an inner surface that defines a club head cavity that extends between the toe portion and the heel portion along the longitudinal axis;

a hosel including a first end and an opposite second end, the first end adapted to be coupled to the club shaft, the second end including a fastener head having an opening extending through the fastener head; and an adjustment assembly removably coupled to the club head and the hosel to facilitate adjusting an orientation of the hosel with respect to the club head, the adjustment assembly including a sliding member, a balancing weight coupled to the sliding member, and a hosel fastener removably coupled to the sliding member, the sliding member being positioned within the club head cavity and movable along the longitudinal axis between the toe portion and the heel portion, the balancing weight including an outer surface having a shape that is configured to be received within the club head cavity, the hosel fastener extending through the fastener head to the sliding member to contact an outer surface of the hosel second end to couple the hosel to the club head.

2. An adjustable golf club system in accordance with claim 1, the club head including an toe opening defined along an outer surface of the toe portion to provide access to the club head cavity, the toe opening configured to receive the sliding member therethrough to enable the sliding member to be inserted through the toe opening and into the club head cavity.

3. An adjustable golf club system in accordance with claim 1, wherein the club head includes a putter head.

4. An adjustable golf club system in accordance with claim 1, the hosel fastener including:

a washer bolt extending through the fastener head towards the sliding member; and a locking bolt inserted through a center cavity extending through the washer bolt and towards the sliding member, the sliding member having an threaded recessed hole configured to receive at least a portion of the locking bolt therein to facilitate coupling the hosel second end to the club head.

5. An adjustable golf club system in accordance with claim 1, the club head including a forward member and an aft member that is removably coupled to the forward member, the forward member including the club head cavity.

6. An adjustable golf club system in accordance with claim 5, the aft member including a projection extending outwardly from an outer surface of the aft member, the forward member including a groove extending between the toe portion and the heel portion, the groove being configured to receive the projection therein to facilitate coupling the aft member to the forward member.

7. An adjustable golf club system in accordance with claim 6, the club head including a pair of head locking bolts to removably couple the aft member to the forward member, each of the pair of head locking bolts being inserted through corresponding openings extending through the aft member.

8. An adjustable golf club system in accordance with claim 1, further comprising a shaft attachment assembly coupled to the hosel to facilitate removably coupling the club shaft to the hosel first end.

9. An adjustable golf club system in accordance with claim 8, the shaft attachment assembly comprising:

a shaft connection cap including an upper portion having a first open end, a lower portion having a second open end, and an inner surface defining a connection cap cavity extending between the first open end and the second open end along a centerline axis, the connection cap cavity configured to receive the club shaft therein through the first open end, the first open end having a first diameter, the second open end having a second diameter that is larger than the first diameter, the upper portion having a substantially frustoconical shape converging from the lower portion towards the first open end; and a shaft connection sleeve positioned within the connection cap cavity and extending through the second open end, the shaft connection sleeve having a inner surface defining an interior cavity extending therethrough and configured to receive the club shaft therein, the shaft connection sleeve including a base member and a plurality of clamping members extending outwardly from the base member along the centerline axis, the clamping members being orientated about the centerline axis, the base member having a threaded outer surface configured to engage a corresponding threaded portion of the inner surface of the shaft connection cap to rotatably couple the shaft connection sleeve to the shaft connection cap, the inner surface of the shaft connection cap contacting the clamping members to bias the clamping members towards the club shaft to contact an outer surface of the club shaft to facilitate forming a friction fit between the clamping members and the club shaft.

10. An adjustable golf club system in accordance with claim 1, the club shaft including a telescoping shaft body including an upper section and a lower section that is rotatably coupled to the upper section, the upper section adapted to rotate with respect to the lower section such that a rotation of the upper section in a first direction increases a length of the shaft body, and a rotation of the upper section in an opposite second direction decreases the overall length of the shaft body.

11. An adjustable golf club system, comprising:

a club shaft including an inner surface that defines an interior chamber;

a club head including:

a body including a front club face and an opposite rear club face, each of the front club face and the rear club face extending between a toe portion and a heel portion along a longitudinal axis; and a recessed portion defined along the rear club face, the recessed portion having an inner surface that defines a club head cavity that extends between the toe portion and the heel portion along the longitudinal axis;

a hosel including a first end and an opposite second end, the first end adapted to be coupled to the club shaft, the second end including a fastener head having an opening extending through the fastener head;

an adjustment assembly removably coupled to the club head and the hosel to facilitate adjusting an orientation of the hosel with respect to the club head, the adjustment assembly including a sliding member and a hosel fastener removably coupled to the sliding member, the sliding member being positioned within the club head cavity and movable along the longitudinal axis between the toe portion and the heel portion, the hosel fastener extending through the fastener head to the sliding member to contact an outer surface of the hosel second end to couple the hosel to the club head; and a shaft attachment assembly coupled to the hosel to facilitate removably coupling the club shaft to the hosel first end, the shaft attachment assembly comprising:

a shaft connection cap including an upper portion having a first open end, a lower portion having a second open end, and an inner surface defining a connection cap cavity extending between the first open end and the second open end along a centerline axis, the connection cap cavity configured to receive the club shaft therein through the first open end, the first open end having a first diameter, the second open end having a second diameter that is larger than the first diameter, the upper portion having a substantially frustoconical shape converging from the lower portion towards the first open end;

a shaft connection sleeve positioned within the connection cap cavity and extending through the second open end, the shaft connection sleeve having a inner surface defining an interior cavity extending therethrough and configured to receive the club shaft therein, the shaft connection sleeve including a base member and a plurality of clamping members extending outwardly from the base member along the centerline axis, the clamping members being orientated about the centerline axis, the base member having a threaded outer surface configured to engage a corresponding threaded portion of the inner surface of the shaft connection cap to rotatably couple the shaft connection sleeve to the shaft connection cap, the inner surface of the shaft connection cap contacting the clamping members to bias the clamping members towards the club shaft to contact an outer surface of the club shaft to facilitate forming a friction fit between the clamping members and the club shaft;

an internal locking device including an inner surface that extends between a top end and a bottom end and defining an expansion cavity the extends between the top end and the bottom end along the centerline axis, the internal locking device including a plurality of expansion members extending outwardly from a main body along the centerline axis, the plurality of expansion members being orientated about the centerline axis and defining an outer surface of the internal locking device that is configured to be inserted within the interior chamber of the club shaft, the main body including a threaded outer surface that is configured to engage a corresponding threaded portion of the inner surface of the shaft connection sleeve;

an expansion bolt configured to be inserted within the expansion cavity to contact the plurality of expansion members to bias the expansion members outwardly towards the inner surface of the club shaft; and a shaft locking bolt configured to be inserted through the bottom end and within the expansion cavity to contact the expansion bolt to move the expansion bolt along the centerline axis towards the top end of the internal locking device, the shaft locking bolt including a threaded outer surface configured to engage a corresponding threaded portion of the inner surface of the internal locking device to rotatably couple the shaft locking bolt to the internal locking device.

12. An adjustable golf club system in accordance with claim 11, the hosel first end including a shaft connection head that is orientated within a first plane, the fastener head being orientated within a second plane that is perpendicular to the first plane, the shaft connection head including a shaft opening extending therethrough, the shaft opening configured to receive the shaft locking bolt therein to facilitate coupling the hosel to the club shaft.

13. An adjustable golf club system comprising:

a club head including:

a body including a front club face and an opposite rear club face, each of the front club face and the rear club face extending between a toe portion and a heel portion along a longitudinal axis; and a recessed portion defined along the rear club face, the recessed portion having an inner surface that defines a club head cavity that extends between the toe portion and the heel portion along the longitudinal axis;

a hosel including a first end and an opposite second end, the first end adapted to be coupled to a club shaft, the second end including a fastener head having an opening extending through the fastener head; and an adjustment assembly removably coupled to the club head and the hosel to facilitate adjusting an orientation of the hosel with respect to the club head, the adjustment assembly including a sliding member, a balancing weight coupled to the sliding member, and a hosel fastener removably coupled to the sliding member, the sliding member being positioned within the club head cavity and movable along the longitudinal axis between the toe portion and the heel portion, the balancing weight including an outer surface having a shape that is configured to be received within the club head cavity, the hosel fastener extending through the fastener head to the sliding member to contact an outer surface of the hosel second end to couple the hosel to the club head.

14. An adjustable golf club system in accordance with claim 13, wherein the club head includes a putter head.

15. An adjustable golf club system in accordance with claim 13, the hosel fastener including:

a washer bolt extending through the fastener head towards the sliding member; and a locking bolt inserted through a center cavity extending through the washer bolt and towards the sliding member, the sliding member having a threaded recessed hole configured to receive at least a portion of the locking bolt therein to facilitate coupling the hosel second end to the club head.

16. An adjustable golf club system in accordance with claim 13, the club head including a forward member and an aft member that is removably coupled to the forward member, the forward member including the club head cavity.

17. An adjustable golf club system in accordance with claim 16, the aft member including a projection extending outwardly from an outer surface of the aft member, the forward member including a groove extending between the toe portion and the heat heel portion, the groove being configured to receive the projection therein to facilitate coupling the aft member to the forward member.

18. An adjustable golf club system in accordance with claim 13, further comprising a shaft attachment assembly coupled to the hosel to facilitate removably coupling the club shaft to the hosel first end, the shaft attachment assembly comprising:

a shaft connection cap including an upper portion having a first open end, a lower portion having a second open end, and an inner surface defining a connection cap cavity extending between the first open end and the second open end along a centerline axis, the connection cap cavity configured to receive the club shaft therein through the first open end, the first open end having a first diameter, the second open end having a second diameter that is larger than the first diameter, the upper portion having a substantially frustoconical shape converging from the lower portion towards the first open end;

a shaft connection sleeve positioned within the connection cap cavity and extending through the second open end, the shaft connection sleeve having a inner surface defining an interior cavity extending therethrough and configured to receive the club shaft therein, the shaft connection sleeve including a base member and a plurality of clamping members extending outwardly from the base member along the centerline axis, the clamping members being orientated about the centerline axis, the base member having a threaded outer surface configured to engage a corresponding threaded portion of the inner surface of the shaft connection cap to rotatably couple the shaft connection sleeve to the shaft connection cap, the inner surface of the shaft connection cap contacting the clamping members to bias the clamping members towards the club shaft to contact an outer surface of the club shaft to facilitate forming a friction fit between the clamping members and the club shaft.

19. An adjustable golf club system, comprising:

a hosel including a first end and an opposite second end, the first end including a shaft connection head adapted to be coupled to a club shaft including an inner surface that defines an interior chamber, the shaft connection head including a shaft opening extending therethrough, the second end including a fastener head configured to be coupled to a club head; and a shaft attachment assembly coupled between the hosel and the club shaft to facilitate removably coupling the club shaft to the hosel, the shaft attachment assembly comprising:

a shaft connection cap including an upper portion having a first open end, a lower portion having a second open end, and an inner surface defining a connection cap cavity extending between the first open end and the second open end along a centerline axis, the connection cap cavity configured to receive the club shaft therein through the first open end, the first open end having a first diameter, the second open end having a second diameter that is larger than the first diameter, the upper portion having a substantially frustoconical shape converging from the lower portion towards the first open end;

a shaft connection sleeve positioned within the connection cap cavity and extending through the second open end, the shaft connection sleeve having a inner surface defining an interior cavity extending therethrough and configured to receive the club shaft therein, the shaft connection sleeve including a base member and a plurality of clamping members extending outwardly from the base member along the centerline axis, the clamping members being orientated about the centerline axis, the base member having a threaded outer surface configured to engage a corresponding threaded portion of the inner surface of the shaft connection cap to rotatably couple the shaft connection sleeve to the shaft connection cap, the inner surface of the shaft connection cap contacting the clamping members to bias the clamping members towards the club shaft to contact an outer surface of the club shaft to facilitate forming a friction fit between the clamping members and the club shaft;

an internal locking device including an inner surface that extends between a top end and a bottom end and defining an expansion cavity the extends between the top end and the bottom end along the centerline axis, the internal locking device including a plurality of expansion members extending outwardly from a main body along the centerline axis, the plurality of expansion members being orientated about the centerline axis and defining an outer surface of the internal locking device that is configured to be inserted within the interior chamber of the club shaft, the main body including a threaded outer surface that is configured to engage a corresponding threaded portion of the inner surface of the shaft connection sleeve;

an expansion bolt configured to be inserted within the expansion cavity to contact the plurality of expansion members to bias the expansion members outwardly towards the inner surface of the club shaft; and a shaft locking bolt configured to be inserted through the bottom end and within the expansion cavity to contact the expansion bolt to move the expansion bolt along the centerline axis towards the top end of the internal locking device, the shaft locking bolt including a threaded outer surface configured to engage a corresponding threaded portion of the inner surface of the internal locking device to rotatably couple the shaft locking bolt to the internal locking device, the shaft locking bolt being inserted through the shaft opening to couple the hosel to the club shaft.

20. An adjustable golf club system in accordance with claim 19, wherein the club shaft club head includes a putter head.

* * * * *